US008132344B2

(12) United States Patent
Perkins et al.

(10) Patent No.: US 8,132,344 B2
(45) Date of Patent: Mar. 13, 2012

(54) SELECTABLE BOOT SUPPORT AND ARTICULATION SYSTEM

(75) Inventors: Brendan Perkins, Salt Lake City, UT (US); Christopher Best, Park City, UT (US); David Narajowski, Park City, UT (US); Derek Gordon Gustafson, Salt Lake City, UT (US); Jacob Hall, Draper, UT (US); Thomas Laakso, Park City, UT (US); Loren Mills, West Jordan, UT (US); Evan Anton Bouchier, Salt Lake City, UT (US)

(73) Assignee: Black Diamond Equipment, Ltd., Salt Lake City ( * ) Notice: Subject to any disclaimer, the term of this patent is extended or adjusted under 35 U.S.C. 154(b) by 444 days.

(21) Appl. No.: 12/494,312

(22) Filed: Jun. 30, 2009

(65) Prior Publication Data

US 2009/0320327 A1 Dec. 31, 2009

Related U.S. Application Data

(60) Provisional application No. 61/077,040, filed on Jun. 30, 2008.

(51) Int. Cl.
*A43B 5/04* (2006.01)

(52) U.S. Cl. ..... 36/118.7

(58) Field of Classification Search ..... 36/118.2–118.9
See application file for complete search history.

(56) References Cited

U.S. PATENT DOCUMENTS

| | | | | | |
|---|---|---|---|---|---|
| 4,665,635 | A | * | 5/1987 | Benoit et al. | 36/118.2 |
| 4,839,973 | A | * | 6/1989 | Dodge | 36/118.7 |
| 4,864,745 | A | * | 9/1989 | Hensler | 36/118.6 |
| 5,001,849 | A | * | 3/1991 | Bidoia | 36/118.7 |
| 5,031,341 | A | * | 7/1991 | Paris et al. | 36/118.8 |
| 5,203,098 | A | * | 4/1993 | Perrissoud et al. | 36/118.7 |
| 5,381,613 | A | * | 1/1995 | Pozzobon et al. | 36/118.9 |
| 5,386,650 | A | | 2/1995 | Storz | |
| 5,718,067 | A | * | 2/1998 | Ostinet et al. | 36/117.1 |
| 6,006,452 | A | * | 12/1999 | Bonaventure | 36/118.8 |
| 6,671,982 | B2 | | 1/2004 | Caeran | |

FOREIGN PATENT DOCUMENTS

| | | |
|---|---|---|
| FR | 2371162 | 6/1978 |
| WO | WO03001937 | 1/2003 |

* cited by examiner

*Primary Examiner* — Ted Kavanaugh
(74) *Attorney, Agent, or Firm* — Baker & Associates PLLC; Trent H. Baker

(57) ABSTRACT

The invention generally relates to a selectable boot articulation and support system. One embodiment of the present invention relates to a boot system including an intercoupled upper and lower shell configured to encase a user's foot and lower leg. The boot system further includes an articulation system effecting the articulation between the upper and lower shell. The articulation system includes an instep member coupled and positioned with respect to the upper shell in a manner that facilitates selection between a locked configuration and an unlocked configuration. The unlocked configuration provides increased articulation and decreased stiffness between the upper and lower shell with respect to the locked configuration. The instep member may include a releasable dorsal coupling between portions of the upper shell. The instep member may also include one or more moveable lateral couplings with the upper shell.

20 Claims, 3 Drawing Sheets

SELECTABLE BOOT SUPPORT AND ARTICULATION SYSTEM

RELATED APPLICATIONS

This application claims priority to U.S. provisional application Ser. No. 61/077,040 filed Jun. 30, 2008, the contents of which are incorporated by reference.

FIELD OF THE INVENTION

The invention generally relates to a selectable boot articulation and support system. In particular, the invention relates to a system for selectable articulation and support characteristics between components of a boot.

BACKGROUND OF THE INVENTION

A boot is a type of footwear that encases both the foot and a portion of the lower leg of a user. Boots are generally manufactured for a particular purpose or activity and therefore are designed to include characteristics consistent with the intended purpose. For example, a hiking boot is designed to support the ankle of a user while minimizing the overall weight. Likewise, a ski boot is designed to maximize a user's performance at a particular skiing activity.

Boots generally include a shell, a compression system, and a sole. The shell and compression system operate to encase and support the foot and lower leg of a user. Various well-known shell compression systems are utilized to allow users to insert and remove their feet in an open boot configuration and thus compress the shell around the foot in a closed boot configuration. For example, one shell system includes an independent upper shell and lower shell hingeably coupled to enable dorsiflexion and plantarflexion of the foot with respect to the lower leg. An alternative shell configuration includes a tongue member extending dorsally along the upper region of the foot. The sole of a boot is disposed on the bottom surface of the shell. The sole is generally composed of a rubber or plastic material. The sole may consist of a single piece or multiple blocks. The stiffness, configuration, and weight characteristics of the sole, shell, and compression have a significant effect on the overall performance of the boot.

Existing boot systems include a selectable articulation system affecting the articulation of the shell with respect to stiffness and range of ankle articulation, so as to facilitate sufficient walking/skinning performance in addition to optimal skiing performance. These articulation systems are generally switchable between a locked/supported configuration and an unlocked/free configuration. The locked configuration corresponds to supporting the shell components to facilitate optimal skiing characteristics. The unlocked configuration corresponds to enabling desired movement between the shell components to facilitate optimal walking and/or skinning. Unfortunately, these existing articulation systems often fail to properly provide optimal support in the locked configuration and often cause undesirable vibrations due to the dimensional freedom necessary to provide the unlocked configuration. In addition, existing systems are often cumbersome, with difficult selection between the locked and unlocked configurations.

Therefore, there is a need in the industry for a selectable boot articulation and support system with an efficient selection mechanism that provides desired support characteristics in the locked configuration.

SUMMARY OF THE INVENTION

The invention generally relates to a selectable boot articulation and support system. One embodiment of the present invention relates to a boot system including an intercoupled upper and lower shell configured to encase a user's foot and lower leg. The boot system further includes an articulation system effecting the articulation between the upper and lower shell. The articulation system includes an instep member coupled and positioned with respect to the upper shell in a manner that facilitates selection between a locked configuration and an unlocked configuration. The unlocked configuration provides increased articulation and decreased stiffness between the upper and lower shell with respect to the locked configuration. The instep member may include a releasable dorsal coupling between portions of the upper shell. The instep member may also include one or more moveable lateral couplings with the upper shell. A second embodiment of the present invention relates to a method for increasing articulation of a boot system, including releasing a dorsal coupler and laterally pivoting an instep member away from the dorsal coupler and instep region of the boot system.

Embodiments of the present invention represent a significant advance in boot articulation system technology. A "power strap" is a conventional external articulation selection system which may be used to increase stiffness (restrict freedom) of a particular boot. Existing integrated boot articulation systems generally include small complex operation mechanisms disposed on the rear portion of a boot, which significantly impede efficient selection between the articulation modes. Likewise, in order to provide the desired freedom in the unlocked configuration, existing integrated articulation systems reduce the overall stiffness and support of the boot system in the locked configuration, thereby negatively effecting overall performance. Existing systems are also generally limited to tongue-based boot shell systems rather than upper/lower-type boot shell systems.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. In the Figures, the physical dimensions may be exaggerated for clarity. The same reference numerals in different drawings represent the same element, and thus their descriptions will be omitted.

DETAILED DESCRIPTION OF THE INVENTION

Figure 1B:
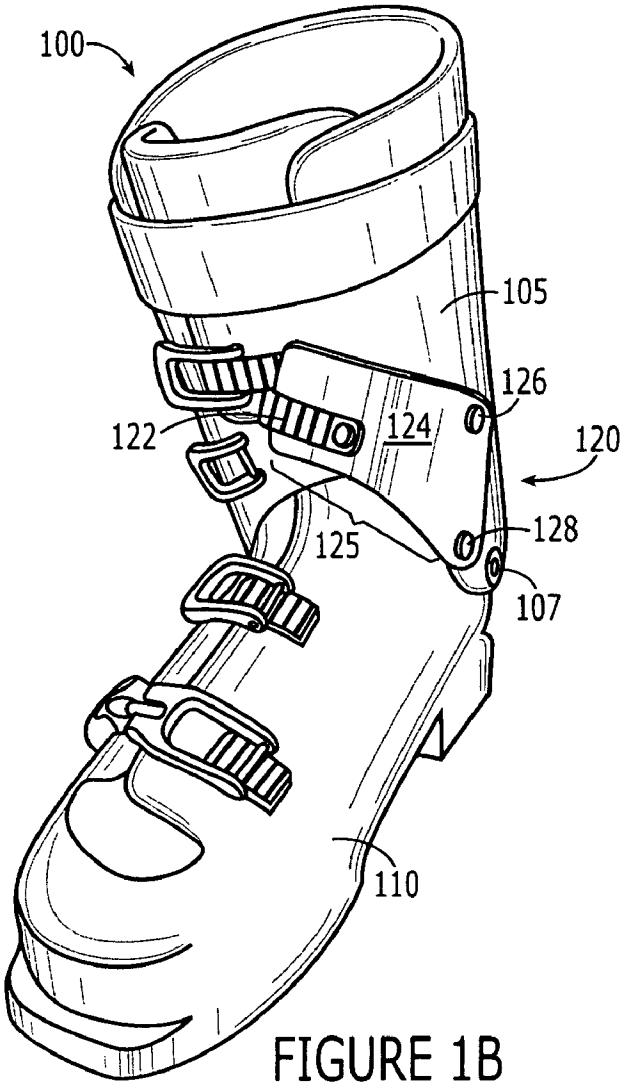
FIG. 1B illustrates a perspective view of the boot system in FIG. 1A, wherein the articulation system is illustrated in a unlocked or free configuration.

The invention generally relates to a selectable boot articulation and support system. One embodiment of the present invention relates to a boot system including an intercoupled upper and lower shell configured to encase a user's foot and lower leg. The boot system further includes an articulation system effecting the articulation between the upper and lower shell. The articulation system includes an instep member coupled and positioned with respect to the upper shell in a manner that facilitates selection between a locked configuration and an unlocked configuration. The unlocked configuration provides increased articulation and decreased stiffness between the upper and lower shell with respect to the locked configuration. The instep member may include a releasable dorsal coupling between portions of the upper shell. The instep member may also include one or more moveable lateral couplings with the upper shell. A second embodiment of the present invention relates to a method for increasing articulation of a boot system, including releasing a dorsal coupler and laterally pivoting an instep member away from the dorsal coupler and instep region of the boot system. Also, while embodiments are described in reference to a ski boot system, it will be appreciated that the teachings of the present invention are applicable to other areas.

The following terms are defined for use within this application:

Freedom—a measurement of movement within and/or between components. With respect to a boot system, a measurement of freedom may correspond to the amount of movement a user's foot may experience within and/or between component(s). For example, the amount a user may move their lower leg/ankle/foot within the upper shell (freedom within the upper shell) of a boot may be directly related to the selectable engagement of a boot articulation system.

Engagement/Disengagement—a state of selective coupling or decoupling between two components. The terms are used broadly such that engagement may include a selective tightening or adjustment within a physically coupled state. Likewise, disengagement may include an extension or slacking of a coupling within a physically coupled state.

Instep region—an anatomical region disposed on the dorsal side of a user's foot and lower leg corresponding to the region across which the user's foot performs dorsiflexion and plantarflexion with respect to the lower leg.

Reference is initially made to FIGS. 1A, 1B, 2A, and 2B, which illustrate perspective and profile views of a boot system, designated generally at 100. The system 100 includes an upper shell 105, a lower shell 110, and an articulation system 120. The upper shell 105 is configured to encase a portion of a user's lower leg within an upper inner region. Likewise, the lower shell 110 is configured to encase a user's foot region within a lower inner region in an overlapping manner in conjunction with the upper shell 105. The upper shell 105 is moveably coupled to the lower shell 110 about two opposite coupling points 107 to enable dorsiflexion and plantarflexion articulation between the upper and lower shells 105, 110 about the instep region. The moveable coupling and/or articulation between the upper and lower shell 105, 110 may be described to include a particular measurement of freedom corresponding to the amount and/or the orientations of movement possible between the upper and lower shell 105, 110 in a particular configuration. Although not discussed, various other forms of user instep, foot, and ankle articulations are also possible within the boot system 100 and may be affected by embodiments of the present invention. The upper and lower shells 105, 110 further include a compression system comprising a set of compression members configured to selectively circumferentially tighten the encasement of the user's foot and lower leg independent of the articulation system. The compression system is generally used to selectively compress the boot system while enabling a user to efficiently insert their foot and lower leg within the corresponding upper and lower shell 105, 110. The illustrated compression members are adjustable compression buckles that include a lengthwise tooth member and a lever member. The illustrated lower shell 110 utilizes an overlapped configuration, and the illustrated upper shell 105 utilizes a cuff configuration. However, it will be appreciated that the teachings of the present invention are applicable to other upper and lower shell configurations, including but not limited to partial and total tongue-based configurations, substantially independent upper and lower shell type configurations, and/or hybrid skeletal shell configurations.

The articulation system 120 selectively affects the freedom between the upper and lower shell 105, 110 including but not limited to articulation and stiffness properties. In particular, the articulation system 120 facilitates user selection between a locked (FIG. 1A, 2A) and an unlocked configuration (FIG. 1B, 2B). The illustrated articulation system 120 includes an instep member 124 moveably coupled to the upper shell 105 via three couplings 122, 126, 128. The three couplings include a releasable dorsal coupler 122, a slidable coupler 126, and a rotatable coupler 128. The slidable coupler 126 and rotatable coupler 128 may also be referred to as the moveable lateral couplings 126, 128. It will be appreciated that various configurations of moveable lateral coupling may be utilized in accordance with the present invention such as a single moveable coupling, compliant spring type couplings, etc. The releasable dorsal coupler 122 is configured to releasably extend laterally, coronally, and/or transversely across the instep region between portions of the upper shell 105. The instep region corresponds to both a region at which the upper and lower shell overlap and the anatomic instep region of a corresponding user's foot. The instep member 124 may include a triangular dimension to facilitate pivotal articulation. The instep member 124 further includes a restricting surface 125 oriented so as to be proximate the instep region. The restricting surface 125 generally extends between the releasable dorsal coupler 122 and the rotatable coupler 128. The restricting surface 125 and instep member 124 include one or more curvatures corresponding to the upper and lower shell 105, 110. Engagement of the releasable dorsal coupler 122 creates a compression force between the releasable dorsal coupler 122 and the moveable lateral couplings 126, 128 which compresses and/or dimensionally reduces the inner regions of the upper shell 105 and/or lower shell 110 via the instep member 124, thereby compressing the upper and lower shell 105, 110 around a user's lower leg and/or foot regions. In addition, the engagement of the releasable dorsal coupler 122 causes the restricting surface 125 to compress and/or bind upon the instep region, thereby restricting freedom between the upper and lower shell 105, 110 which has the effect of increasing support and stiffness characteristics of the overall boot system 100. The illustrated releasable dorsal coupler 122 is a male compression buckle, but it will be appreciated that any releasable coupling may be utilized and remain consistent with the teachings of the present invention.

The two moveable lateral couplings 126, 128 enable the instep member 124 to articulate between two positions corresponding to the locked and unlocked configurations of the articulation system. The slidable coupler 126 may be translatably free with respect to a channel or recess 106 (see FIG. 2A) on the upper shell 105. The rotatable coupler 128 may enable rotational freedom between the instep member 124 and the upper shell 105. The rotatable coupler 128 is disposed in substantial proximity to one of the oppositely oriented coupling points 107 between the upper and lower shell 105, 110. In one non-illustrated embodiment, the rotatable coupler 128 may be co-located or disposed in the same position as one of the oppositely oriented coupling points 107 for consolidation of articulating boot regions. In the illustrated embodiment, the slidable coupler 126 and rotatable coupler 128 operate in conjunction to enable the instep member 124 to pivot, move, and/or rotate about the rotatable coupler 128 if the releasable dorsal coupler 122 is disengaged. The described pivoting, movement, and/or rotation of the instep member 124 enables a translation of the restricting surface 125 of the instep member 124 away from the instep region in the unlocked configuration (1B, 2B). The ability to disengage and laterally pivot the instep member 124 from the instep region of the boot system 100 increases freedom between the upper and lower shell 105, 110 by removing the restricting surface 125 of the instep member 124 from a region at which certain forms of relative movement between the upper and lower shell 105, 110 occur. This form of movement significantly affects the stiffness and range of motion between the upper and lower shell 105, 110. It will be appreciated that the term "lateral" and "laterally" are defined broadly to include either left or right side region of the foot and boot system 100.

The locked or supported configuration (FIGS. 1A, 2A) of the articulation system correspond to a particular positioning of the instep member 124 and an engagement of the releasable dorsal coupler 122 to the upper shell 105. The engagement of the releasable dorsal coupler 122 circumferentially compresses the upper shell 105 around the corresponding lower leg region of the user's leg and/or foot. The engagement of the releasable dorsal coupler 122 to the upper shell 105 may include tensile extension across the instep member 124 and a portion of the upper shell 105 via the slidable and rotatable couplers 126, 128. The unlocked or free configuration (FIGS. 1B & 2B) of the articulation system correspond a disengagement/release of the releasable dorsal coupler 122 from the upper shell 105 and a pivot, movement, and/or rotation of the instep member 124 away from the instep region. The effect of disengaging the releasable dorsal coupler 122 from the upper shell 105 corresponds to disengaging the circumferential compression of the upper shell 105 around the instep region that would otherwise impede dorsiflexive and plantarflexive articulation. The effect of moving the instep member 124 away from the instep region of the system 100 is release of the restricting surface 125 of the instep member 124 from the instep region of the boot system 100, thereby increasing freedom between the upper and lower shell 105, 110. In addition, the unlocked configuration of the articulation system 120 maintains circumferential encasement and sufficient compression of the upper shell 105 around the user's lower leg, thereby simplifying the transition between locked and unlocked configurations.

Figure 1A:
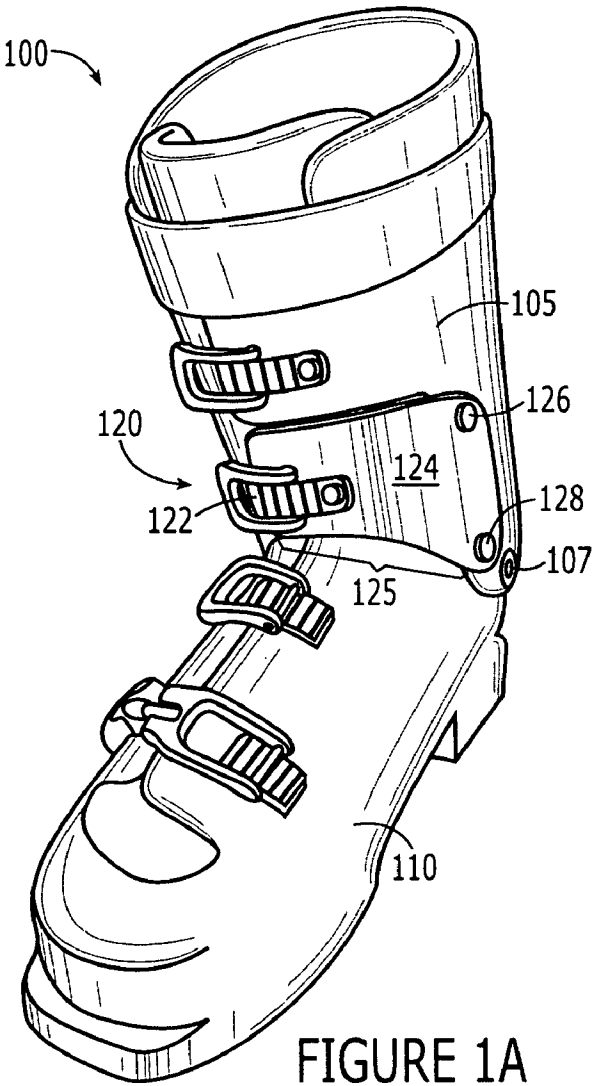
FIG. 1A illustrates a perspective view of a boot system with an articulation system in accordance with embodiments of the present invention, wherein the articulation system is illustrated in a locked or supported configuration.
Figure 2B:
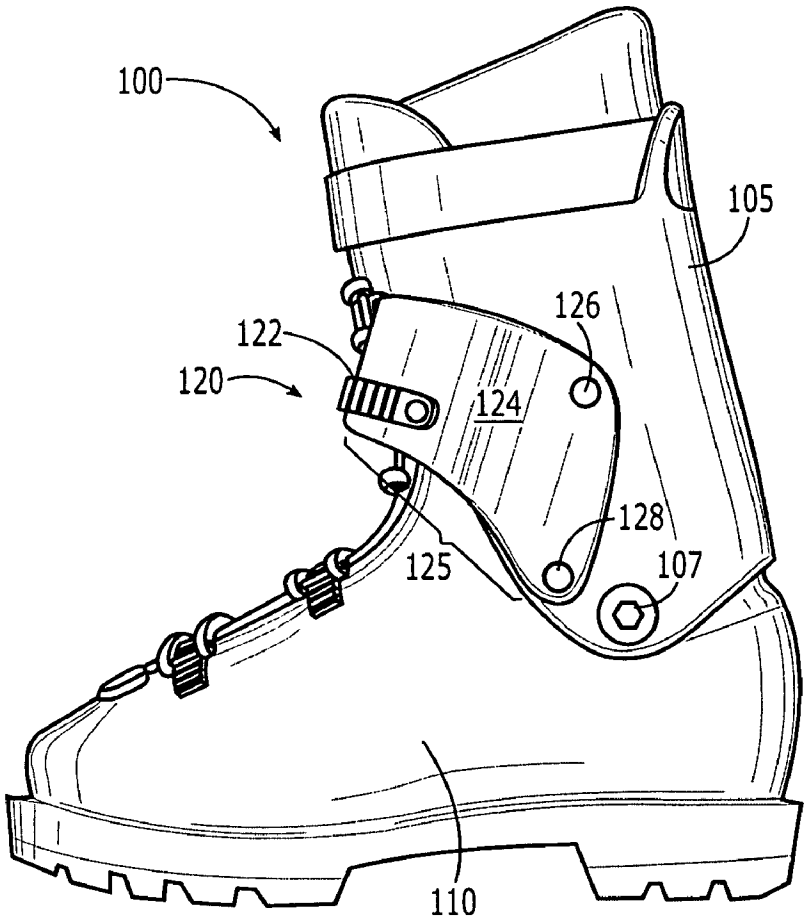
FIG. 2B illustrates a profile view of the boot system in FIG. 1A, wherein the articulation system is illustrated in a unlocked or free configuration.
Figure 2A:
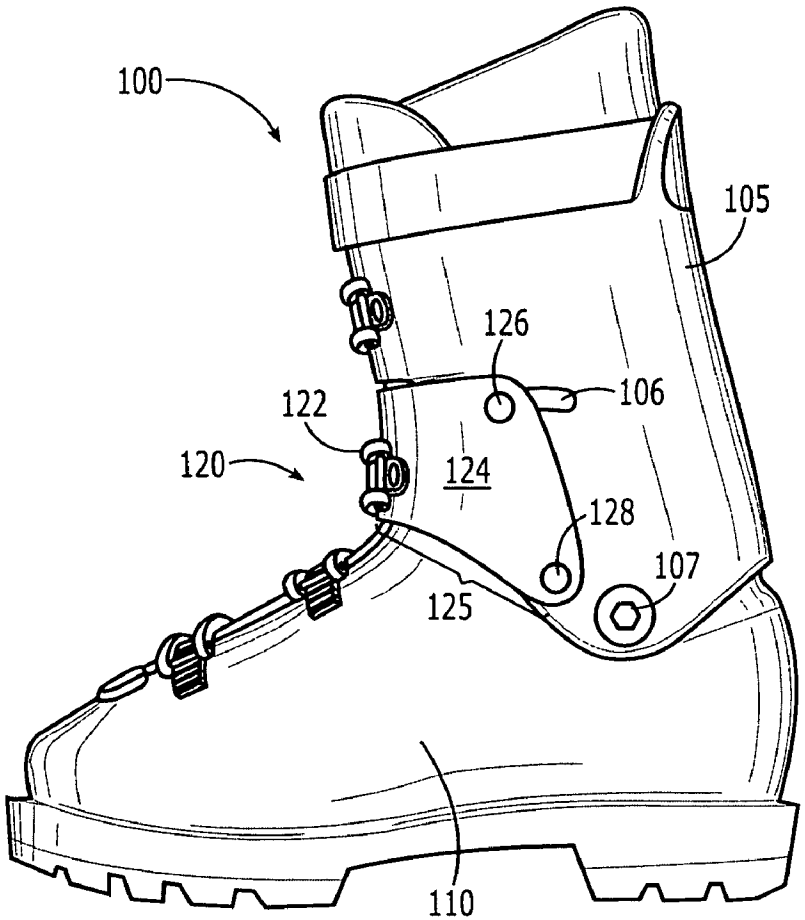
FIG. 2A illustrates a profile view of the boot system in FIG. 1A, wherein the articulation system is illustrated in a locked or supported configuration.
Figure 3B:
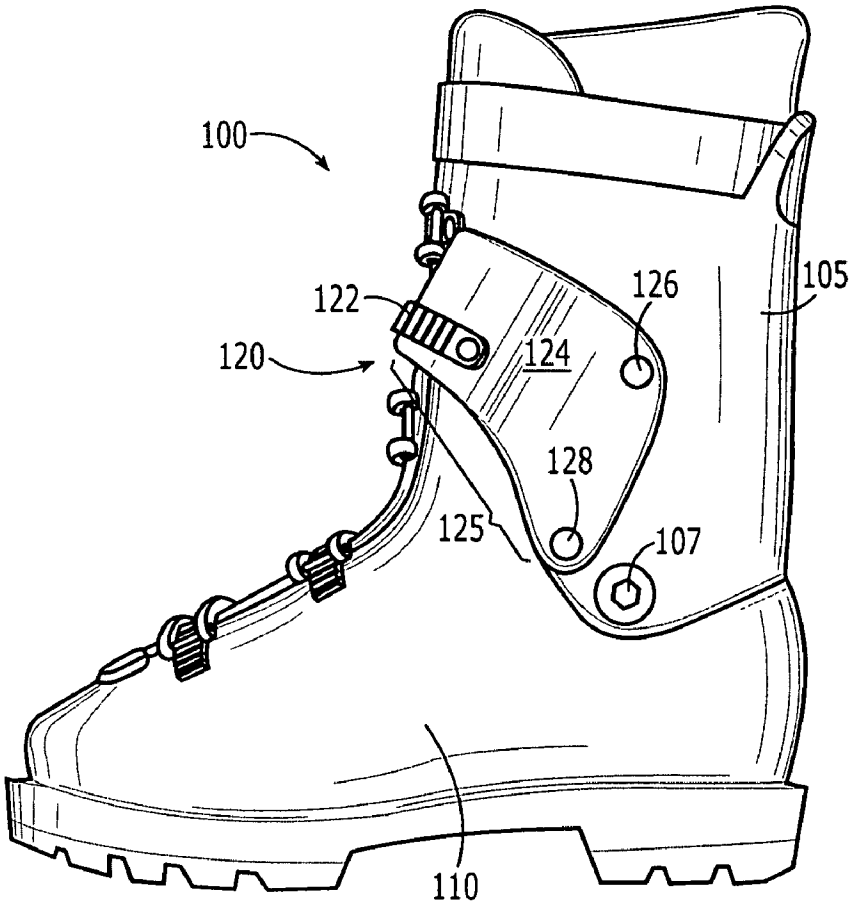
FIG. 3B illustrates a profile view of the boot system in FIG. 1A, wherein the articulation system is illustrated in an unlocked or free configuration, and wherein the upper shell is articulated backward with respect to the lower shell.
Figure 3A:
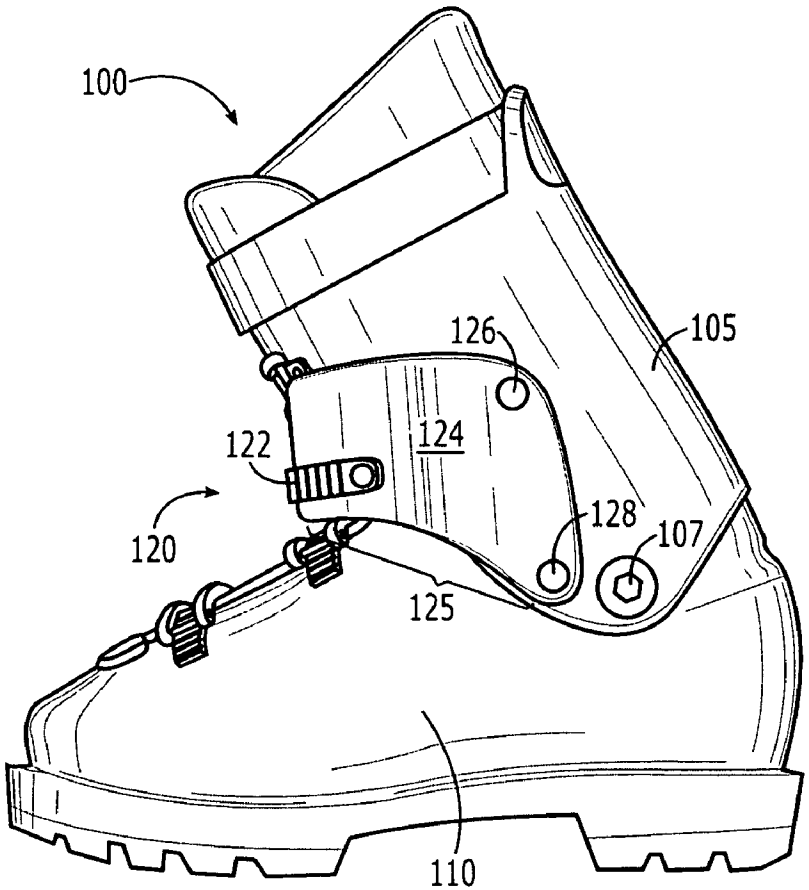
FIG. 3A illustrates a profile view of the boot system in FIG. 1A, wherein the articulation system is illustrated in an unlocked or free configuration, and wherein the upper shell is articulated downward with respect to the lower shell.

Reference is next specifically made to FIGS. 3A and 3B, which illustrate profile views of the boot system of FIG. 1A, designated generally at 100. FIGS. 3A and 3B both illustrate the articulation of the boot system 100 in the unlocked or free configuration. In particular, FIG. 3A illustrates maximal forward articulation (dorsiflexion) of the upper shell 105 with respect to the lower shell 110. In FIG. 3A, the upper shell 105 is articulated about the opposite coupling points (only 107 is visible) with respect to the lower shell 110. The moveable dorsal coupler 122 is released and/or disengaged from the upper shell 105. The instep member 124 is articulated and positioned such that the restricting surface 125 does not substantially interfere with the forward articulation of the upper shell 105 with respect to the lower shell 110. Likewise, FIG. 3B illustrates maximal rearward articulation (plantarflexion) of the upper shell 105 with respect to the lower shell 110.

Although not illustrated various additional embodiments have been considered, including but not limited to alternative shell configurations, alternative shell geometries, alternative moveable lateral couplings, alternative coupling locations, alternative instep member geometries, alternative instep member articulation paths, etc. One alternative non-illustrated shell configuration may include the use of a tongue member in addition to or in the alternative of one of the first and second shell. One alternative non-illustrated articulation system may include replacing the illustrated slidable coupler 126 and rotatable coupler 128 by a single hinge type moveable coupler to enable the instep member 124 to laterally rotate away from the instep region of the system 100 in the unlocked or free configuration. Likewise, the slidable coupler 126 and rotatable coupler 128 may be replaced by a moveable or non-moveable single coupler. For example, if the single coupler is non-moveable, the articulation system may include bending of the instep member 124 with respect to the upper shell 105 to effectuate moving the instep member 124 away from the instep region.

What is claimed is:

1. A boot system comprising:

an upper shell configured to encase a portion of a user's lower leg within an upper inner region;

a lower shell configured to encase a user's foot within a lower inner region, wherein the lower shell is moveably coupled to the upper shell;

an articulation system including a locked configuration and an unlocked configuration, wherein the locked configuration restricts freedom within and between each of the upper shell, lower shell, and moveable coupling between the upper and lower shell, and wherein the unlocked configuration increases freedom within and between each of the upper shell, lower shell, and moveable coupling between the upper and lower shell with respect to the locked configuration;

wherein the articulation system includes an instep member moveably coupled to the upper shell, and wherein the moveable coupling of the instep member includes a releasable dorsal coupling between portions of the upper shell, and wherein the moveable coupling of the instep member includes at least one moveable lateral coupling to the upper shell;

wherein the locked configuration corresponds to an engagement of the releasable dorsal coupling across the upper shell; and wherein the unlocked configuration corresponds to a disengagement of the releasable dorsal coupling and an articulation of the instep member across the upper shell about the at least one moveable lateral coupling.

2. The boot system of claim 1, wherein the engagement of the releasable dorsal coupling of the instep member dimensionally reduces the upper inner region, and wherein the engagement of the releasable dorsal coupling of the instep member restricts the freedom between the upper and lower shell, and wherein the engagement of the releasable dorsal coupling of the instep member dimensionally reduces the lower inner region.

3. The boot system of claim 1, wherein the releasable dorsal coupling includes an adjustable compression buckle substantially coronally oriented, and wherein the at least one moveable lateral couplings are configured to restrict a compression force across a portion of the upper shell in the engaged state of the releasable dorsal coupling.

4. The boot system of claim 1, wherein the articulation of the instep member includes substantially disposing the instep member with respect to the upper and lower shell at a position away from an instep region.

5. The boot system of claim 1, wherein the articulation of the instep member includes substantially disposing the instep member at a position rotationally clockwise from an instep region.

6. The boot system of claim 1, wherein the articulation of the instep member includes substantially disposing the instep member at a position pivotally rotated about the at least one moveable lateral coupling from an instep region.

7. The boot system of claim 1, wherein the articulation of the instep member increases the freedom between the upper and lower shell.

8. The boot system of claim 1, wherein the moveable coupling between the upper and lower shell is moveable about two opposite coupling points, and wherein the at least one moveable lateral coupling of the instep member includes a rotatable coupling in substantial proximity to one of the two opposite coupling points.

9. The boot system of claim 1, wherein the at least one moveable lateral coupling of the instep member includes a slidable coupling including a channel recess disposed on the upper shell, and wherein the articulation of the at least one moveable lateral coupling includes a translation of a portion of the instep member within the channel recess.

10. The boot system of claim 1, wherein the lower shell includes a tongue region extending dorsally within a sagittally oriented opening in the upper shell.

11. The boot system of claim 1, wherein the at least one moveable lateral coupling of the instep member is disposed on a lateral side of the upper shell corresponding to the instep side of the user's foot.

12. The boot system of claim 1, wherein the instep member includes at least one curvature substantially aligned with at least one of the upper and lower shell.

13. The boot system of claim 1, wherein the instep member includes restricting surface, and wherein in the locked configuration the restricting surface is disposed over an instep region, and wherein the restricting surface is disposed away from the instep region in the unlocked configuration.

14. A boot system comprising:

an upper shell configured to encase a portion of a user's lower leg within an upper inner region;

a lower shell configured to encase a user's foot within a lower inner region, wherein the lower shell is moveably coupled to the upper shell;

an articulation system including a locked configuration and an unlocked configuration, wherein the locked configuration restricts freedom within and between each of the upper shell, lower shell, and moveable coupling between the upper and lower shell, and wherein the unlocked configuration increases freedom within and between each of the upper shell, lower shell, and moveable coupling between the upper and lower shell with respect to the locked configuration;

wherein the articulation system includes an instep member moveably coupled to the upper shell, and wherein the moveable coupling of the instep member includes a releasable dorsal coupling between portions of the upper shell, and wherein the moveable coupling of the instep member includes at least one moveable lateral coupling to the upper shell;

wherein the locked configuration corresponds to an engagement of the releasable dorsal coupling across the upper shell including disposing a restricting surface at an instep region, wherein the engagement of the releasable dorsal coupling of the instep member dimensionally reduces the upper inner region, and wherein the engagement of the releasable dorsal coupling of the instep member restricts the freedom between the upper and lower shell, and wherein the engagement of the releasable dorsal coupling of the instep member dimensionally reduces the lower inner region; and wherein the unlocked configuration corresponds to a disengagement of the releasable dorsal coupling and an articulation of the instep member about the at least one moveable lateral coupling, wherein the articulation of the instep member includes substantially disposing the instep member with respect to the upper and lower shell at a position away from the instep region.

15. A method for selectively restricting freedom between an upper and lower shell of a boot system comprising the acts of:

providing a boot system including an upper shell configured to encase a portion of a user's lower leg within an upper inner region;

a lower shell configured to encase a user's foot within a lower inner region, wherein the lower shell is moveably coupled to the upper shell;

an articulation system including a locked configuration and an unlocked configuration, wherein the locked configuration restricts freedom within and between each of the upper shell, lower shell, and moveable coupling between the upper and lower shell, and wherein the unlocked configuration increases freedom within and between each of the upper shell, lower shell, and moveable coupling between the upper and lower shell with respect to the locked configuration;

wherein the articulation system includes an instep member moveably coupled to the upper shell, and wherein the moveable coupling of the instep member includes a releasable dorsal coupling between portions of the upper shell, and wherein the moveable coupling of the instep member includes at least one moveable lateral coupling to the upper shell;

wherein the locked configuration corresponds to an engagement of the releasable dorsal coupling across the upper shell; and wherein the unlocked configuration corresponds to a disengagement of the releasable dorsal coupling and an articulation of the instep member across the upper shell about the at least one moveable lateral coupling;

providing an instep member moveably coupled to the upper shell;

disposing a restricting surface of the instep member at an instep region;

engaging a releasable dorsal coupling between the instep member and the upper shell;

compressing the upper shell around the user's lower leg;

compressing the lower shell around the user's foot; and restricting the freedom between the upper and lower shell.

16. The method of claim 15, wherein the act of disposing a restricting surface of the instep member at an instep region includes articulating the instep member about at least one lateral moveable coupling so as to coronally extend across the upper shell.

17. The method of claim 15, wherein the act of disposing a restricting surface of the instep member at an instep region includes a counter-clockwise rotation of the instep member about at least one lateral moveable coupling.

18. The method of claim 15, wherein the act of engaging a releasable dorsal coupling between the instep member and the upper shell includes inducing a circumferential compression force at the instep region.

19. The method of claim 15, wherein the act of engaging a releasable dorsal coupling between the instep member and the upper shell includes inducing a compression force between the restricting surface and the lower shell.

20. The method of claim 15, wherein the act of engaging a releasable dorsal coupling between the instep member and the upper shell includes inducing an tensile force between the releasable dorsal coupling and at least one moveable lateral couplings of the instep member to the upper shell.

* * * * *